US010076757B2

(12) United States Patent
De Vos

(10) Patent No.: US 10,076,757 B2
(45) Date of Patent: Sep. 18, 2018

(54) SYSTEM FOR AND METHOD OF CHANGING TEMPERATURES OF SUBSTANCES

(75) Inventor: Gert De Vos, Goes (NL)

(73) Assignee: MOLECULAR BIOLOGY SYSTEMS B.V., 'S-Heer Hendrikskinderen (NL)

( * ) Notice: Subject to any disclaimer, the term of this patent is extended or adjusted under 35 U.S.C. 154(b) by 392 days.

(21) Appl. No.: 14/119,638

(22) PCT Filed: May 24, 2011

(86) PCT No.: PCT/NL2011/050354
§ 371 (c)(1),
(2), (4) Date: Apr. 8, 2014

(87) PCT Pub. No.: WO2012/161566
PCT Pub. Date: Nov. 29, 2012

(65) Prior Publication Data
US 2014/0220579 A1 Aug. 7, 2014

(51) Int. Cl.
*B01L 7/00* (2006.01)
*B01L 3/00* (2006.01)

(52) U.S. Cl.
CPC ..... *B01L 7/54* (2013.01); *B01L 7/5255* (2013.01); *B01L 3/505* (2013.01); *B01L 7/52* (2013.01);
(Continued)

(58) Field of Classification Search
CPC ..... B01L 2200/022; B01L 2300/18; B01L 2300/1883; B01L 2400/0481; B01L 3/505;
(Continued)

(56) References Cited

U.S. PATENT DOCUMENTS 3,036,894 A * 5/1962 Forestiere ..... B01L 3/505 206/484
3,620,678 A * 11/1971 Rue Jean Mermoz ..... B01L 3/505 422/66
(Continued)

FOREIGN PATENT DOCUMENTS

CN 1406154 A 3/2003
EP 0723812 7/1996
(Continued)

OTHER PUBLICATIONS

"PCR Processor", Research Disclosure, Mason Publications, Hampshire, GB, No. 396, Apr. 1, 1997 (Apr. 1, 1997), pp. 207-211, XPOO0702403, ISSN: 0374-4353 the whole document, Cited in ISR.
(Continued)

*Primary Examiner* — Jonathan M Hurst
(74) *Attorney, Agent, or Firm* — Young & Thompson

(57) ABSTRACT

A temperature control device for controlling a temperature of a substance to obtain a first temperature and to change to a second temperature has first and second heating blocks and a heating device. The heating device heats the first and second heating blocks to the first and second temperatures, respectively. The temperature control device has a first material opposing the first heating block to define a first space between them arranged to receive the substance and to define a first temperature zone having substantially the first temperature. The temperature control device has a second material opposing the second heating block such as to define a second space between them arranged to receive the substance and define a second temperature zone having substantially the second temperature, the first and second spaces
(Continued)

being arranged such that the substance can be moved from the first temperature zone to the second temperature zone.

19 Claims, 5 Drawing Sheets

(52) U.S. Cl.
CPC ..... *B01L 7/525* (2013.01); *B01L 2200/022* (2013.01); *B01L 2300/18* (2013.01); *B01L 2300/1883* (2013.01); *B01L 2400/0481* (2013.01)

(58) Field of Classification Search
CPC ..... B01L 7/525; B01L 7/5255; B01L 7/54; B01L 7/52; B01L 2300/0829
See application file for complete search history.

(56) References Cited

U.S. PATENT DOCUMENTS

| | | | | |
|---|---|---|---|---|
| 5,525,300 | A * | 6/1996 | Danssaert | B01L 7/52 422/552 |
| 5,736,106 | A | 4/1998 | Ishiguro et al. | |
| 7,955,840 | B2 | 6/2011 | Belgrader | |
| 8,329,433 | B2 | 12/2012 | Belgrader | |
| 8,676,383 | B2 | 3/2014 | Tan et al. | |
| 8,906,652 | B2 | 12/2014 | Belgrader | |
| 2002/0049557 | A1* | 4/2002 | Chen | B01F 11/0065 702/116 |
| 2005/0221281 | A1* | 10/2005 | Ho | B01L 3/5025 435/4 |
| 2008/0038813 | A1* | 2/2008 | Chen | A61B 5/1427 435/287.2 |
| 2010/0028887 | A1* | 2/2010 | Ebersole | C12Q 1/6806 435/6.16 |
| 2010/0261230 | A1 | 10/2010 | Liu et al. | |
| 2011/0057117 | A1* | 3/2011 | Fawcett | B01L 7/52 250/458.1 |
| 2011/0203942 | A1* | 8/2011 | Uchiyama | G01N 27/3274 205/782 |

FOREIGN PATENT DOCUMENTS

| | | | |
|---|---|---|---|
| JP | 04-330272 | A | 11/1992 |
| JP | 0703469 | | 11/1995 |
| JP | 08196299 | | 8/1996 |
| JP | 09224644 | | 9/1997 |
| JP | 2010502228 | | 1/2010 |
| JP | 2010536374 | | 12/2010 |
| WO | 02/057798 | A2 | 7/2002 |
| WO | 03/007677 | A1 | 1/2003 |
| WO | 2005/100538 | A1 | 10/2005 |
| WO | 2008030914 | | 3/2008 |
| WO | 2009025881 | | 2/2009 |
| WO | 2010/033135 | A1 | 3/2010 |
| WO | 2010/140982 | A1 | 12/2010 |
| WO | 2011/054353 | A1 | 5/2011 |

OTHER PUBLICATIONS

International Search Report, dated Jun. 11, 2012, from corresponding PCT application.

* cited by examiner

SYSTEM FOR AND METHOD OF CHANGING TEMPERATURES OF SUBSTANCES

FIELD OF THE INVENTION

The present invention relates to a system that can be used to quickly change the temperature of certain substances. One of its applications is in the field of nucleic acid amplification techniques such as PCR (Polymerase Chain Reaction).

BACKGROUND OF THE INVENTION

In molecular biology, nucleic acid amplification techniques such as PCR (Polymerase Chain Reaction) are used for amplification of short polynucleotide sequences of RNA or DNA (up to 1000 nucleotides, but occasionally longer, up 10.000 nucleotides or even longer). The PCR process has been performed for the first time in 1989 by Kary Mullis.

Typically, in this process, a template of double-stranded DNA is heated to a first, denaturating temperature where DNA denatures; i.e. the double helix structure of DNA unwinds and its polynucleotide strands are separated. Usually this first temperature is 367-369 Kelvin. Depending on the sequence of the DNA template, lower temperatures or higher temperatures may be used.

In the next step, the temperature is lowered to a second, annealing temperature where primers (short, specific sequences of synthetic or non-synthetic DNA, usually 20 bases long, although primers may be longer or shorter as deemed necessary) can anneal to the denatured, single-stranded template. Usually, this second temperature is in the range of 321-343 Kelvin, more preferably 331-335 Kelvin, although higher as well as lower temperatures may be used depending on the primers used.

In the third step, the temperature is changed to a third, optimal, extension temperature, usually 345-347 Kelvin, although higher as well as lower temperatures may be used, where a polymerase enzyme, preferably a heat stable enzyme, will extend the primers with nucleotides complementary to the nucleotides of the single-stranded template.

Then the process is repeated, i.e. the mixture is returned to the denaturing temperature. This process, one calls thermal cycling. Usually 30 cycles are used to perform a PCR-reaction, although higher as well as lower cycle counts may be used.

In known embodiments (which may equally be applied in the present invention) a step-down PCR process may be applied in which the annealing temperature is lowered slightly in steps after a predetermined number of cycles.

For reactions that employ primers with high melting temperature (close to the extension temperature), a two step cycling, omitting the second, annealing temperature action may be used: annealing and extension are combined in a single step. The reaction usually takes place in a reaction vessel, called an "eppendorf tube" or in reaction plates with 96 or 384 wells. Plates and tubes are usually made of polypropylene. Other plastics may be found suitable. Other formats, such as glass tubes, are possible.

The duration of the PCR process is dependent on the speed of the reaction and on the speed and accuracy of temperature changing (thermal cycling). Over the years a number of ways to perform thermal cycling have been proposed and a number of them have been brought into practice.

The first PCR-reactions have been performed by manually changing the reaction tubes from one thermo stated water bath to the next, while timing all steps. This process was useful for the first experiments, but cumbersome and time consuming.

The first automated thermal cyclers used heating elements to heat aluminium blocks in which reaction tubes were seated. For cooling of the blocks water was used. These first machines performed PCR in approximately 4 hours.

The next generation used Peltier elements to heat and cool the blocks. These machines generate temperature transients of up to 5 K/s. Cooling is slower: at maximum −4.5 K/s. PCR can be performed in between 2 and 4 hours. Faster machines exist (Applied Bio Systems, Stratagene RoboCycler, ThermoFischer PikoCycler). The Robocycler moves plates from one temperature block to the next, using a robot arm. The Applied Bio Systems and the PikoCycler use fast temperature ramping (5 K/s and −4.5 K/s); the PikoCycler uses reaction vessels with thinner walls (average 150 μm). All of these are more or less hindered in speed by the lag in temperature of the liquid in the tubes.

Faster machines (Roche light cycler, Idaho Technology) use thermostated air to control the temperature of PCR mixtures in glass tubes. Temperature transients of 17 K/s can be reached during heating, but cooling depends on ambient temperature. PCR can be performed in 30 minutes and some cases in 20 minutes. Usually a reaction still takes approximately 1 hour.

Attempts have been made to change the temperature by creating temperature gradients inside the mixture in the test tube. Convection would then take the mixture, with its ingredients through the consecutive temperature steps automatically. This system has lately been improved by creating the temperature gradient under a slope, in order to generate better convection.

Pump systems have been designed to pump the mixture through the different temperature zones, which have been separated in space, inside a tube made from for example PTFE.

PCR on chip depends on moving very small amounts of mixture, i.e. droplets with no more than several nano liters through temperature zones, which have been created. Moving can be done by pumping or by magnetic fields, if the DNA has been labelled with magnetic beads.

Yet another system changes the temperatures in purposely-constructed cuvettes by blowing gas of the correct temperature under high pressure through the cuvette.

SUMMARY OF THE INVENTION

The object of the invention is to provide a device that can be used to change the temperature of a substance in a faster way than known from the prior art.

To that effect, the invention provides a temperature control device with one or more embodiments.

A system comprising such a device with one or more embodiments of the system.

BRIEF DESCRIPTION OF THE DRAWINGS

The invention will be explained in detail with reference to some drawings that are only intended to show embodiments of the invention and not to limit the scope. The scope of the invention is defined in the annexed claims and by its technical equivalents.

The drawings show.

DETAILED DESCRIPTION OF EMBODIMENTS

Here a system is proposed for changing the temperature in substances, preferably reaction mixes, more preferably nucleic acid amplification reaction mixes, even more preferably PCR-reaction mixes, most preferably a liquid PCR-reaction mix, with great speed and accuracy.

In accordance with an embodiment of the invention, which is applicable to PCR reactions, enclosures are produced filled with a PCR reaction mix. Such a PCR reaction mix may comprise water, DNA-template, DNA polymerase, nucleotides, primers, buffer, MgCl2 and PCR enhancers and other substances, which may help the PCR reaction.

Enclosures can be made from very thin material, because the shape of the enclosure is not dependent on the rigidity of the material. Its shape is also not necessarily fixed. The enclosures may have walls down to 0.01 mm or thinner, depending on the strength and other properties of the material of which the enclosure is made. These thin walls help generate extreme temperature ramps, as will be explained in further detail hereinafter. To obtain such high temperature ramps, the volume of one enclosure may advantageously be in the range of 5 to 100 preferably in the range of 10 to 50 μl, most preferably in the range of 10 to 20 μl.

The enclosure consists of a suitably temperature resistant plastic, which does not interfere with the PCR reaction and which can be closed on all sides, even after the mix has been added and thus moisture may be present at the site of sealing.

Figure 1A:
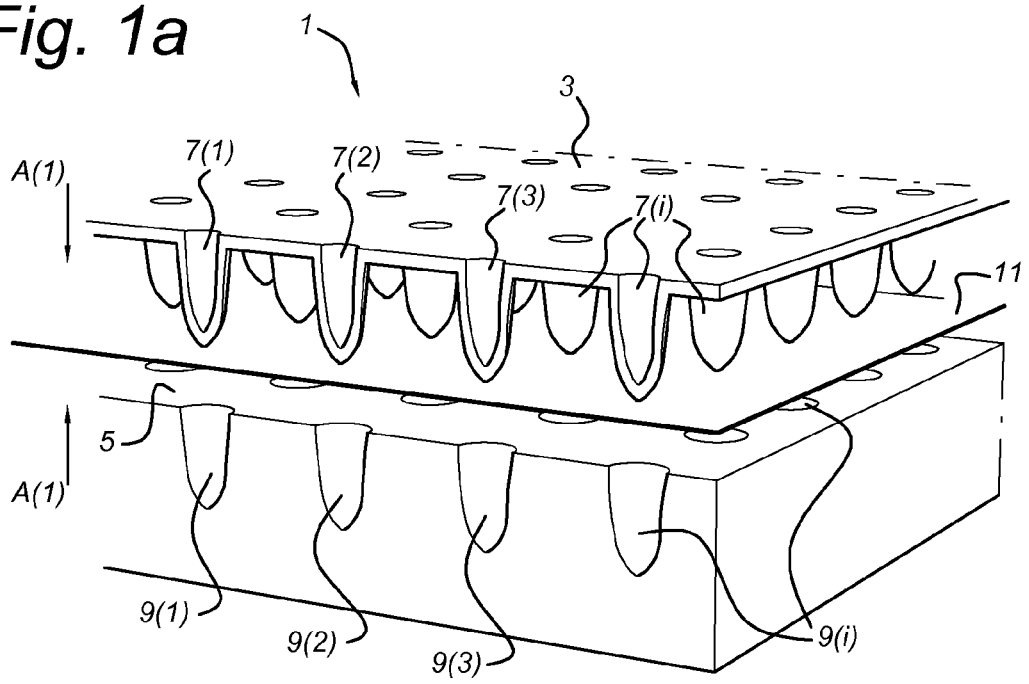
FIGS. 1A-1C show a method of making bags 17(*i*) filled with a substance to be changed in from one temperature to another.

An example of such an enclosure is a bag, which may be produced in a way as explained with reference to FIGS. 1A-1C. FIG. 1A shows a device 1 for producing such enclosures in the form of bags.

FIG. 1A shows the device 1 with a first plate 3 and a second plate 5, both shown in cross sectional view. The first plate 3 has one or more extensions 7(*i*). These extensions may be hollow as shown. However, they may also be solid. They may have a circular cross section in a first view parallel to a top surface of the first plate 3. They may have a oval shaped cross section in a second view perpendicular to the first view. However, the invention is not restricted to these shapes. For example, the cross sectional view parallel to the surface of the first plate 3 may be rectangular or may have any other suitable cross section shape.

The second plate 5 has one or more openings 9(*i*) arranged such and shaped such that each opening 9(*i*) can receive a corresponding extension 7(*i*) of the first plate. Preferably the outer shape of the extensions 7(*i*) substantially corresponds to the inner shape of the openings 9(*i*).

In order to form one or more bags a plastic foil 11 is arranged between the first plate 3 and the second plate 5. Both the first plate 3 and the second plate 5 are heated to a predetermined temperature. These temperatures may be equal and are chosen such as to soften the plastic foil 11 when they contact the plastic foil 11. As indicated by arrows A(1), the first and second plate are moved towards one another such that each extension 7(*i*) is received by a corresponding opening 9(*i*). The softened plastic foil is pushed into openings 9(*i*) by extensions 7(*i*) such as to form bags 17(*i*) (FIG. 1B). As many bags 17(*i*) will be formed as there are extensions 7(*i*) and openings 9(*i*). These bags 17(*i*) are connected to one another by the portion of plastic foil 11 not pushed inside openings 9(*i*).

It is observed that one of the plates 3, 5 may remain in a fixed position and only the other one need be moved in order to generate the movement as indicated by arrows A(1). The plates 3, 5 may be made of aluminium, steel or any other material with sufficiently high melting temperature and sufficiently high heat transfer coefficient. Their temperature in use may be in a range between 323 K and 573 K, more preferably 323 K and 473 K, most preferably 373 K and 443 K, in case the plastic foil is propylene. The plastic may be polypropylene. However, any other suitable material may be used instead, such as e.g. polyethylene, polyethene, PMMA (=polymethylmethacrylaat), POM (=polyoxymethylene), etc.

The plates 3, 5 are removed from one another and the plastic foil 11 with bags 17(*i*) are removed from the device 1. Then, the plastic foil 11 with bags 17(*i*) is arranged such that the bags 17(*i*) are inserted into corresponding openings 15(*i*) in a third plate 13. The third plate 13 is not heated (so, is at room temperature) and may be made of glass, a suitable metal or a suitable polymer.

Figure 1B:
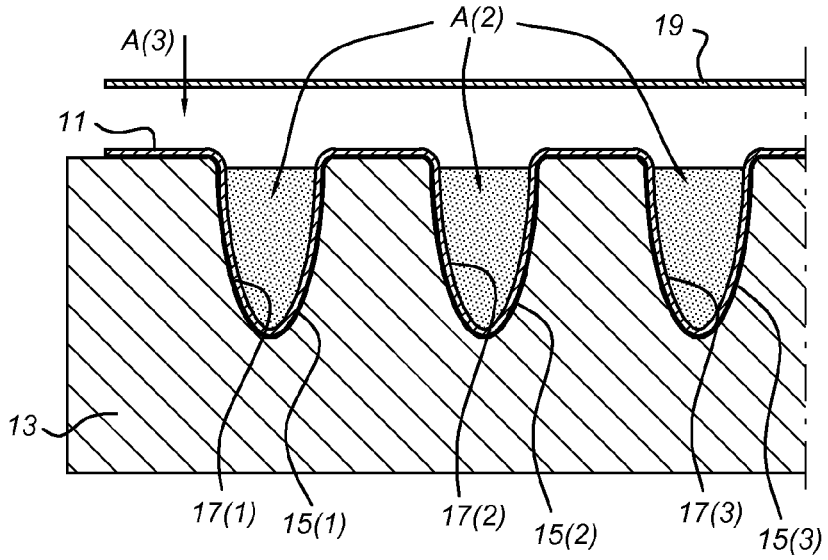
Figure 1C:
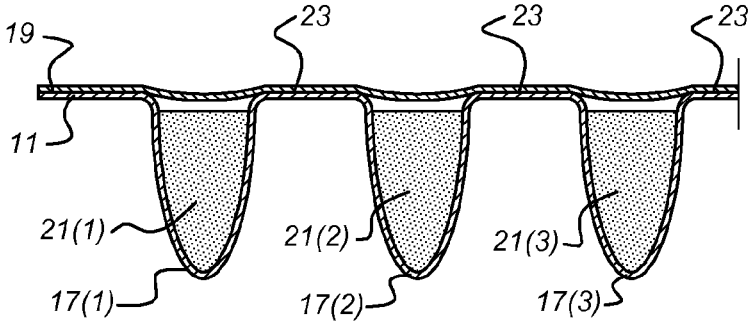

Once inserted in the openings 15(*i*) the bags are filled with a predetermined PCR reaction mix, as indicated in FIG. 1B, with arrows A(2).

A further plastic foil 19 is provided on top of plastic foil 11. As indicated with arrows A3 this further plastic foil 19 is laid down on the plastic foil 11. At locations 23, see FIG. 1C, the further plastic foil is sealed to plastic foil 11. Locations 23 are located between bags 17(*i*) and are locations where further plastic foil 19 contacts plastic 11. For sealing any suitable means and methods may be used, such as gluing, heating, applying ultra sound etc.

The extensions 7(*i*) and openings 9(*i*) may be arranged in a matrix arrangement. Then, the bags 17(*i*) will also be arranged in a matrix arrangement. Any number (for example 96) of bags may be placed in parallel in separate lines, or connected. bags may also be joined in series to create a matrix of bags. Alternatively, a sheet of polypropylene foil can be produced to include rows and columns of bags 17(*i*) (e.g. one row in 8 or 12 columns, or 12 rows in 8 columns). Bags 17(*i*) may be circular, rectangular or may have any other suitable cross section shape. Numbers are meant to serve as an example.

FIGS. 2A, 2B, 3, 4 and 5 show (parts of) embodiments of a temperature control device used to heat and coil down the bags 17(*i*) to predetermined temperatures.

Figure 2A:
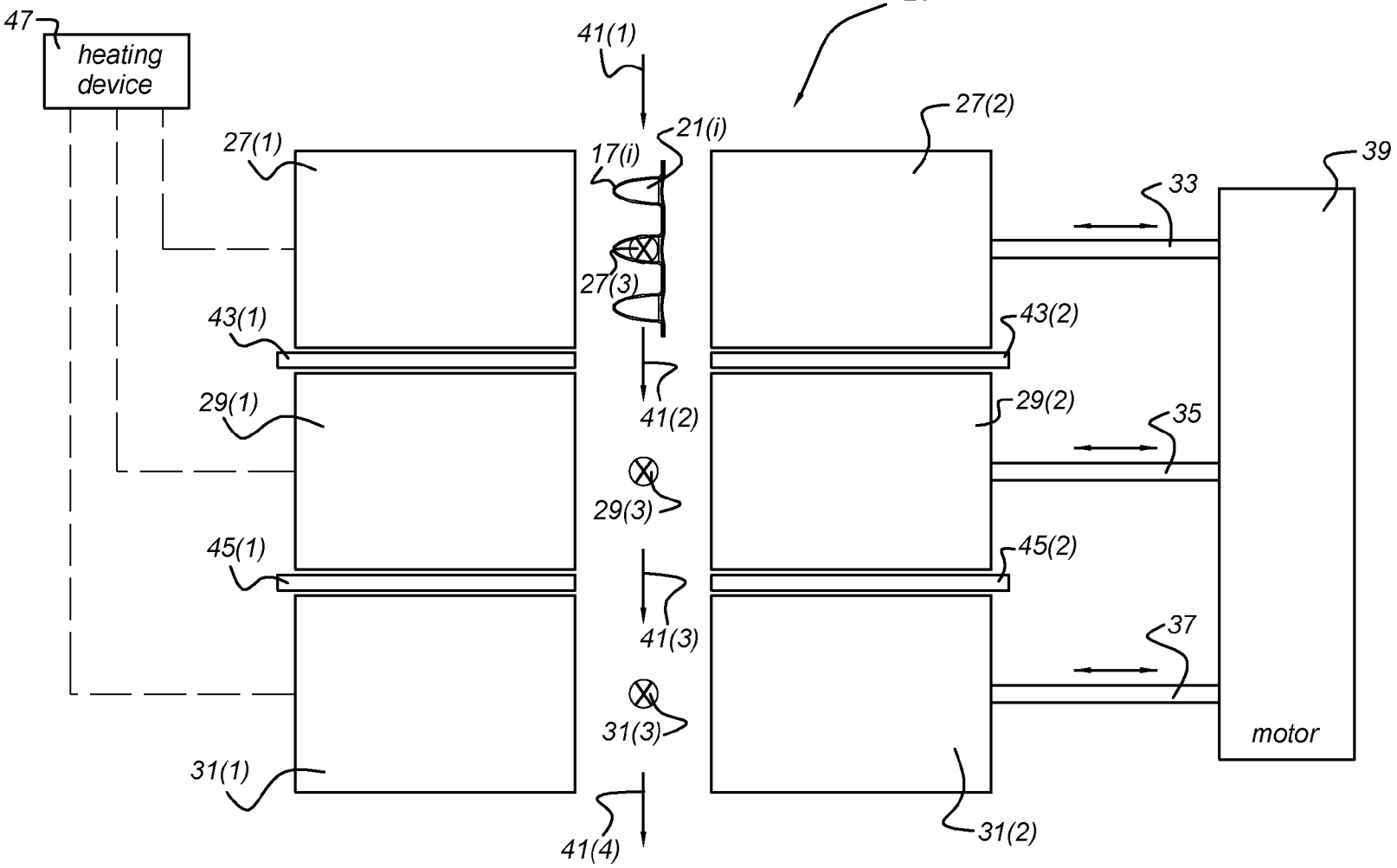
FIGS. 2A, 2B, 3, 4, 5, 6, 7 show embodiments of the temperature control device according to the invention.

FIG. 2A shows a temperature control device 25. The temperature control device 25 is provided with three sets of heating blocks, a first set of heating blocks 27(1)/27(2), a second set of heating blocks 29(1)/29(2) and a third set of heating blocks 31(1)/31(2). These sets of heating blocks may be made of aluminium. The first set of heating blocks 27(1)/27(2) is separated from the second set of heating blocks 29(1)/29(2) by a first temperature isolating material, such as a set of heat separation blocks 43(1)/43(2) made, e.g., from POM (=polyoxymethylene). The second set of heating blocks 29(1)/29(2) is separated from the third set of heating blocks 31(1)/31(2) by a second temperature isolating material, such as a set of heat separation blocks 45(1)/45(2) made, e.g., from POM.

Each of the heating blocks is heated by a suitable, only schematically indicated heating device 47 to be at a predetermined temperature. In case of a PCR cycle, the first set of heating blocks 27(1)/27(2) are heated to a first temperature between 367-369 Kelvin, the second set of heating blocks 29(1)/29(2) to a second temperature between 321-343 Kelvin, more preferably 331-335 Kelvin, and the third set of heating blocks 29(1)/29(2) to a third temperature between 345-347 Kelvin. Of course, for other applications other temperatures may be applied. The heating device 47 may be arranged as three separate heating units, one for each set of heating blocks 27(1)/27(2), 29(1)/29(2), 31(1)/31(2). However, it may also consist of a single heating unit arranged to control the temperature of each one of the sets of heating blocks 27(1)/27(2), 29(1)/29(2), 31(1)/31(2). Other arrangements are possible. For instance, there may be ten such heating blocks: two at a temperature of 367K, two at 345K, two at 333K, two at 331K and two at 329K.

Instead of aluminium any other metal, alloy or plastic or other material with sufficiently high heat capacity and heat transmission coefficient can be used. Instead of POM any other material or substance with sufficiently low heat transmission coefficient can be used. As an example, the heating blocks may be manufactured as heating bags, filled with liquid, such as water. They will have higher heat capacity and heat transfer is supported by internal convection. Also heating bags with heated gas can be used. Aluminium and POM are merely meant to serve as an example. Also a gas can be used as an isolating material.

The system should be setup in such a way that, when the temperature of the substance, e.g. the reaction mix within bag 17(*i*) is heated/cooled to the desired temperature, the heating blocks 27(1)/27(2), 29(1)/29(2), 31(1)/31(2) remain at substantially the same temperature. This can be obtained by providing each one of the sets of heating blocks 27(1)/27(2), 29(1)/29(2), 31(1)/31(2) with a heat capacity of at least ten times the heat capacity of the substance of which the temperature should be controlled. However, a larger ratio between the heat capacity of the heating blocks and the substance to be heated is preferred, such as more than 50.

Thus, in case, such heating blocks 27(1)/27(2), 29(1)/29(2), 31(1)/31(2) are to be used in a PCR process, and to control temperature changes of a volume of PCR mixes with a volume between 5 and 100 μl. in, for instance, 30 cycles, each of such heating blocks (1)/27(2), 29(1)/29(2), 31(1)/31(2) may be made aluminium and have a weight between 40 and 500 grams.

By this construction, the sets of heating blocks 27(1)/27(2), 29(1)/29(2), 31(1)/31(2) are consecutively separated by POM blocks 43(1)/43(2), 45(1)/45(2), isolating the sets of heating blocks 27(1)/27(2), 29(1)/29(2), 31(1)/31(2) at different temperatures from each other. More heating blocks/POM blocks can be added when more temperature zones are needed, fewer heating blocks/POM blocks can be used when fewer temperature zones are needed.

Each set of heating blocks 27(1)/27(2), 29(1)/29(2), 31(1)/31(2) are joined to create a space between them, in which a bag 17(*i*) containing a substance or a mix, preferably a reaction mix, more preferably a nucleic acid amplification reaction mix, even more preferably a PCR-reaction mix, most preferably a liquid PCR-reaction mix is placed.

The heating device 47 may be any device known to persons skilled in the art suitable for heating/cooling, such as, but not limited to, pocket heating elements, peltier elements, liquid streams, gas streams, evaporation of liquids, pressurised evaporation-condensation cycling, etc.

Preferably the heating control device 25 comprises a driving device, like a motor 39, to shift heating blocks from one single set of heating blocks back and forth towards and away from one another. The motor 39 is indicated to be connected to one of the heating blocks 27(2), 29(2), 31(2) of each set of heating blocks 27(1)/27(2), 29(1)/29(2), 31(1)/31(2), to provide them with such movement relative to the other one of the set. Of course, other arrangements may be used to provide such relative movement between heating blocks of a set of heating blocks.

Between the first set of heating blocks 27(1)/27(2) there is a first temperature zone 27(3), between the second set of heating blocks 29(1)/29(2) there is a second heating zone 29(3), and between the third set of heating blocks 31(1)/31(2) there is a third heating zone 31(3). The spaces between the individual heating blocks of the sets of heating blocks 27(1)/27(2), 29(1)/29(2), 31(1)/31 is made such that the first temperature zone 27(3) equals substantially the same first temperature T1 as the first set of heating blocks 27(1)/27(2), the second temperature zone 29(3) equals substantially the same second temperature T2 as the second set of heating blocks 29(1)/29(2), and the third temperature zone 31(3) has substantially the same third temperature T3 as the third set of heating blocks 31(1)/31(2). By moving the bag 17(*i*) from one temperature zone to the next, as indicated with consecutive arrows 41(1)-41(4), the temperature of the bag 17(*i*) and its content can be changed rapidly. The bags may be moved manually or by a suitable motor. Temperature transients of 500 K/s and more of the substance/mix inside the bag 17(*i*) are possible, provided the heat capacity of the heating blocks 27(1)/27(2), 29(1)/29(2), 31(1)/31(2) is substantially larger than the heat capacity of the bag 17(*i*) and its content. When more temperature zones are needed more sets of blocks can be added. Temperature zones may be large enough to accommodate a plurality of bags 17(*i*). For instance, a cassette with a matrix of bags 17(*i*) may be located in each one of the temperature zones 17(*i*).

To improve concentration of all mix in one side of the bag 17(*i*), the construction may be placed vertically, i.e., in use first set of heating blocks 27(1)/27(2) is above second set of heating blocks 29(1)/29(2), and second set of heating blocks 29(1)/29(2) is above third set of heating blocks 31(1)/31(2). By doing so, the mix will be concentrated in the lower part of the bag 17(*i*) under the influence of gravity.

The motor 39 is arranged to move individual heating blocks of one set to one another such as to press against the bag 17(*i*) which such force as to not destroy the bag 17(*i*) with its content. For instance, such force may be in a range of 1-10 N, preferably between 3-8 N, more preferably between 4-6 N, such as 5 N. By pressing the heating blocks of one set of heating blocks in a temperature zone 27(3), 29(3), 31(3) together, the content of the bag 17(*i*) will be forced to take on a new shape. Therefore, if the contents are, for instance, reagents of a certain chemical/biological reaction in a liquid, these reagents inside the liquid will be mixed by such pressing, causing faster heat transmission to the fluid. Alternatively the bags 17(*i*), part of the system or the whole system may be shaken in order to mix the fluid, causing rapid heat transfer to the fluid. This method may also be applied to other designs of thermocyclers than the one explained here. Pressing may also serve as a means to increase the physical contact surface between the bag 17(*i*) and the heating blocks 27(1)/27(2), 29(1)/29(2), 31(1)/31(2), therefore, enhancing the transmission of heat to the liquid or from the liquid.

Tests as performed by the inventor of the present invention, have shown that, even in case a 30 cycle PCR process is performed manually (i.e. the bags 17(*i*) are transferred from one temperature zone 27(3), 29(3), 31(3) to the next manually), this may be done in as fast as 7 minutes.

Figure 3:
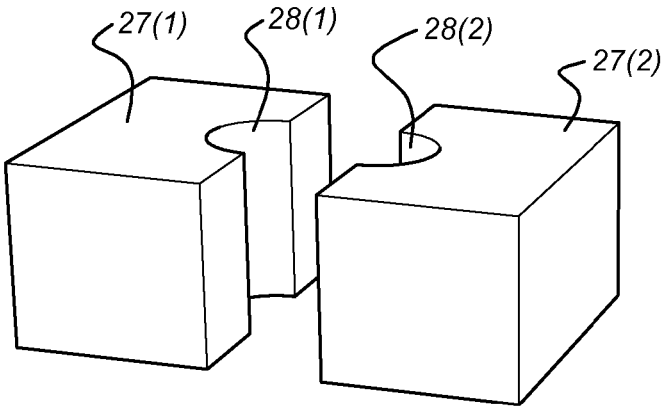

FIG. 3 shows an embodiment in which each of the heating blocks 27(1)/27(2) is profiled with a slot 28(1)/28(2) to improve heat transduction. Such slots 28(1)/28(2) are facing one another such as to create a tunnel to exactly fit the shape of a bag 17(*i*). In an embodiment it is envisaged that, in use, two or more bags 17(*i*) are located in parallel in the space between the heating blocks 27(1)/27(2). In such case, a plurality of slots may be machined into the opposing sides of heating locks 27(1)/27(2) such as to create several parallel tunnels for a plurality of bags 17(*i*). Although FIG. 3 shows slots for heating blocks 27(1)/27(2), it will evident that such slots may be provided any one of the heating blocks 27(1)/27(2), 29(1)/29(2), 31(1)/31. Slots 28(1), 28(2) may be shaped to not exactly match the shape of the bags 17(*i*), such that the content is mixed when heating blocks 27(1)/27(2), 29(1)/29(2), 31(1)/31 are pressed together. The slots may have nay suitable cross section shape, like a half circle, part of a polygon, part of an ellipse, etc.

A plurality of bags 17(*i*) may be joined on a sheet of suitable material, such as polypropylene. Other suitable materials may be used. Polypropylene merely serves as an example. Alternatively, a plurality of bags 17(*i*) may be joined in a cassette, designed to separate the blocks as the bags 17(*i*) move through them. Other means to separate the heating blocks 27(1)/27(2), 29(1)/29(2), 31(1)/31 when the bags 17(*i*) are moved in between them, such as a solenoid or a motor or a balloon will be known to those skilled in the art. The methods mentioned here serve as an example.

The bags 17(*i*) may be moved from one zone 27(3), 29(3), 31(3) to the next by means of a slide, operated by a suitable motor (not shown). Any other device designed to move an object in a one or multidimensional space may be used. Methods and devices will be known to anyone skilled in the art.

Figure 4:
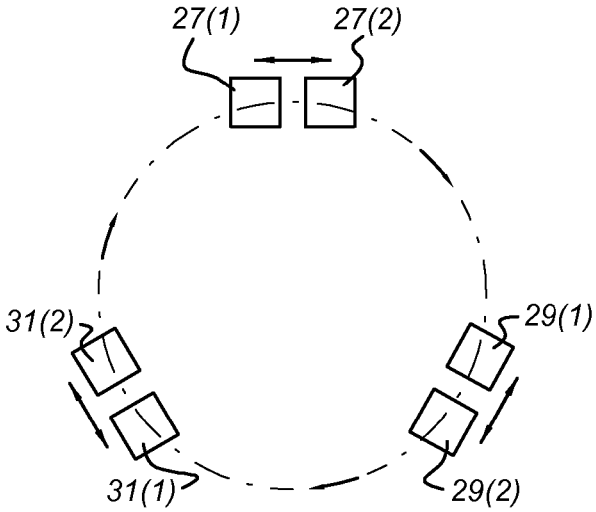
Figure 5:
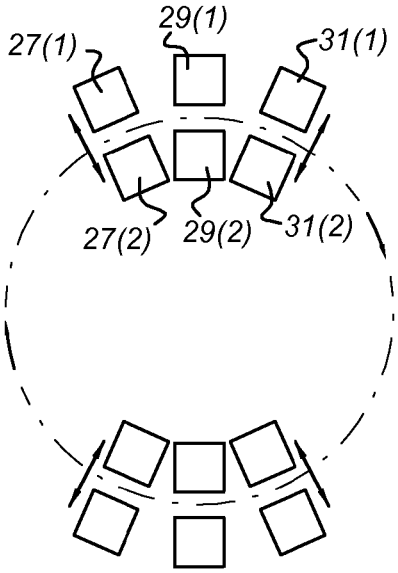

Further alternative arrangements are shown in FIGS. 4 and 5. FIG. 4 shows a circular arrangement of the heating control device, i.e., the sets of heating blocks 27(1)/27(2), 29(1)/29(2), 31(1)/31 are arranged on a circle. In the arrangement of FIG. 4, all heating blocks 27(1)/27(2), 29(1)/29(2), 31(1)/31 are equally spaced from the centre of a single circle. In the arrangement of FIG. 5, a first one 27(1), 29(1), 31(1) heating block set is located on a first distance from the centre of a circle, whereas the second one of the heating block sets is located on a second distance from that circle such that a circular trajectory of the bags 17(*i*) is located between the first and second ones of each heating block set. As also indicated in FIG. 5, more than one set of sets of heating blocks 27(1)/27(2), 29(1)/29(2), 31(1)/31 may be arranged on a single circle. Each set is arranged to provide one cycle of the 30 cycles of a PCR process. In this way, by moving the bags 17(*i*) along a single circular trajectory the total process of 30 cycles may further be accelerated.

As a further alternative, the two heating blocks of each pair of heating blocks 27(1)/27(2), 29(1)/29(2), 31(1)/31 can be located above one another such that are equally spaced from the centre of the circle and the plane of the circle is located between two opposing ones of each pair. The bags 17(*i*) can then be moved in the plane of the circle between the heating blocks 27(1)/27(2), 29(1)/29(2), 31(1)/31.

Figure 6:
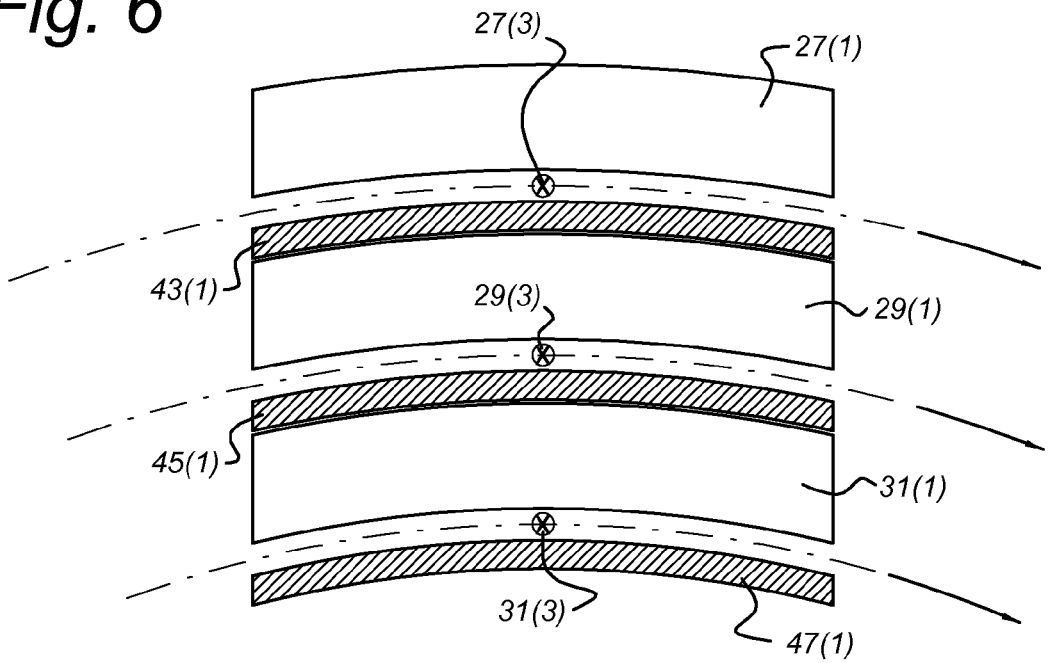

Alternatively, the circular construction can be made from two (or more) concentric, cylindrically shaped heating blocks, as shown in FIG. 6. FIG. 6 shows a first heating block 27(1) located on the outer side of a first circle, a second heating block 29(1) located within the first circle and on the outer side of a second circle with smaller radius than the first circle, and a third heating block 31(1) located within the first circle and on the outer side of a third circle with smaller radius than the second circle. The first heating block 27(1) and second heating block 29(1) are separated by a first isolator 43(1) located on the inner side of the first circle. The second heating block 29(1) and third heating block 31(1) are separated by a second isolator 45(1) located on the inner side of the second circle. Moreover, a third isolator 47(1) is located on the inner side of the third circle. In this way, a first temperature zone 27(3) at a first temperature T1 can be generated between the first heating block 27(1) and the first isolator 43(1) by heating the first heating block 27(1) to a suitable temperature. A second temperature zone 29(3) at a second temperature T2 can be generated between the second heating block 29(1) and the second isolator 45(1) by heating the second heating block 29(1) to a suitable temperature. A third temperature zone 29(3) at a third temperature T3 can be generated between the third heating block 31(1) and the third isolator 47(1) by heating the third heating block 31(1) to a suitable temperature. The bags 17(*i*) can be moved along the concentric circles to be heated consecutively to the temperatures T1, T2, and T3. All materials of this embodiment can be the same as in other embodiments.

Figure 7:
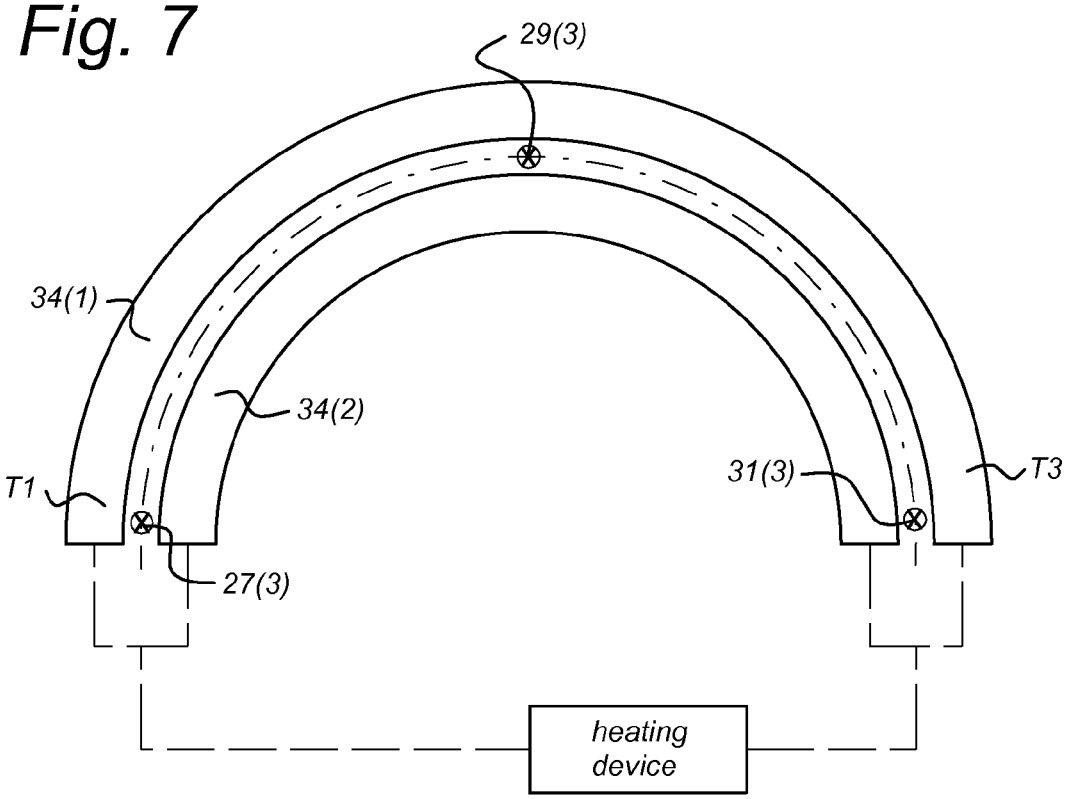

In a further embodiment, at least one heating block with an internal temperature gradient is used. One embodiment is shown in FIG. 7. The embodiment of FIG. 7 comprises two concentrically located heating blocks 34(1), 34(2). A first end of both concentric heating blocks 34(1), 34(2) is heated to the first temperature T1 and the second end is heated to the third temperature T3. Thus, while bags 17(*i*) are moved along a trajectory between the concentric heating blocks from the first end to the second end, they will be moved from first temperature zone 27(3) at temperature T1 to third temperature zone 27(3) at temperature 31(3). The temperature of their content will therefore change from T1 to T3. In between the first and second temperature zones there will be a location where there is second temperature 29(3) at temperature T2, in between T1 and T3. The movement of bags 17(*i*) will be controlled to stay long enough in temperature zones 27(3), 29(3), 31(3) to cause a required process, like a PCR process, to occur within them. Movement may be done manually or by any suitable driving device as explained with reference to embodiments above.

Instead of arranging second heating block 34(2), a temperature isolator of any suitable form and material may be arranged such that the three temperature zones 27(3), 29(3), and 31(3) are created.

The arrangement as shown in FIG. 7 need not be implemented with concentric units. It may equally well be made with rectangular block shaped units, or any other suitable form.

DNA-fragments produced in the PCR-reaction during thermal cycling may be labeled by labeling units known to those skilled in the art and which are added to the content of the bags 17(*i*) prior to sealing them. An example of such labeling units is Invitrogen's Sybr Green, which emits photons after excitation with a predetermined wavelength of light, but only when bound to double stranded DNA. Another example of labeling units is Applied Biosystems TaqMan probe. TaqMan probes consist of a fluorophore covalently attached to the 5'-end of the oligonucleotide probe and a quencher at the 3'-end. As long as the fluorophore and the quencher are in proximity, quenching inhibits any fluorescence signals. TaqMan probes are designed such that they anneal within a DNA region amplified by a specific set of primers. As the Taq polymerase extends the primer and synthesizes the nascent strand, the 5' to 3' exonuclease activity of the polymerase degrades the probe that has annealed to the template. Degradation of the probe releases the fluorophore from it and breaks the close proximity to the quencher, thus relieving the quenching effect and allowing fluorescence of the fluorophore. Hence, fluorescence detected in a real-time PCR thermal cycler is directly proportional to the fluorophore released and the amount of DNA template present in the PCR.

Other suitable labelling methods, generating an optical signal, may be used. Using optical signals serves as an example. Labels generating other signals, such as altered behaviour in strong magnetic fields, e.g. magnetic resonance, when coupled to double stranded DNA may be used. Those skilled in the art will understand which other methods can be used.

In order to detect the produced amount of DNA at the end of a PCR process, in principle, two different approaches can be used.

The first one is to detect the product at the end of the PCR process, i.e. after application of the third, extension temperature. This setup can be used completely independently from the PCR process as explained above. This detection gives the amount of product produced during the reaction. For this a small scanner can be built. The scanner will consist of a plate, for example made from glass, on which to place the bags 17(*i*) after the thermal cycling has been performed. Other suitable material instead of glass can be used. These materials will be known to those skilled in the art. The bags 17(*i*) may be pressed on the plate such that two opposing, substantially flat surface of the bags 17(*i*) are created at a predetermined distance. This supports a well defined scanning process.

On the other side of the glass a suitable lamp for excitation can be used. The wavelength of the excitation light depends on the label employed. Suitable lamps may be Xenon-lamps. Other suitable light sources will be known to those skilled in the art. Filtering may be used to transmit a predetermined excitation wavelength to the label, selected such as to excite the label. Examples of suitable filters are coloured glass or plastic sheets or grids. Combinations of multiple filters may be used. On the other side of the bags 17(*i*) a stationary or moving detector, for example a CCD-chip can be used to create a signal. The CCD-chip may be combined with a lens to form a camera. Filters may be employed between the bags 17(*i*) and the CCD-chip to isolate the emission signal from the label from other wavelengths. Examples of suitable filters are coloured glass or plastic sheets or grids. Combinations of multiple filters may be used. The scanner may be connected to a computer by means known to those skilled in the art, e.g. through a USB. In order to be able to produce melting curves per product produced in a bag 17(*i*), the scanner can be constructed to be able to control the temperature of the liquid in the bag 17(*i*). By ramping the temperature of the liquid from one temperature T1 to the next temperature T2, where T2 is higher than T1 and T1 is sufficiently low to allow all products formed to be double stranded DNA and T2 is sufficiently high to allow all products formed to exist as single stranded DNA (melted). During this process all products will transit from their double stranded form to their single stranded form at their own temperature and with kinetics specific for this product. When going from their double stranded form to their single stranded form, the label (for example SYBR Green) will be detached from the product and seize emitting a signal. In this way, the melting temperature of each of the products in a bag 17(*i*) can be determined. It also allows for counting the number of products with different melting temperatures and kinetics inside one enclosure.

Figure 2B:
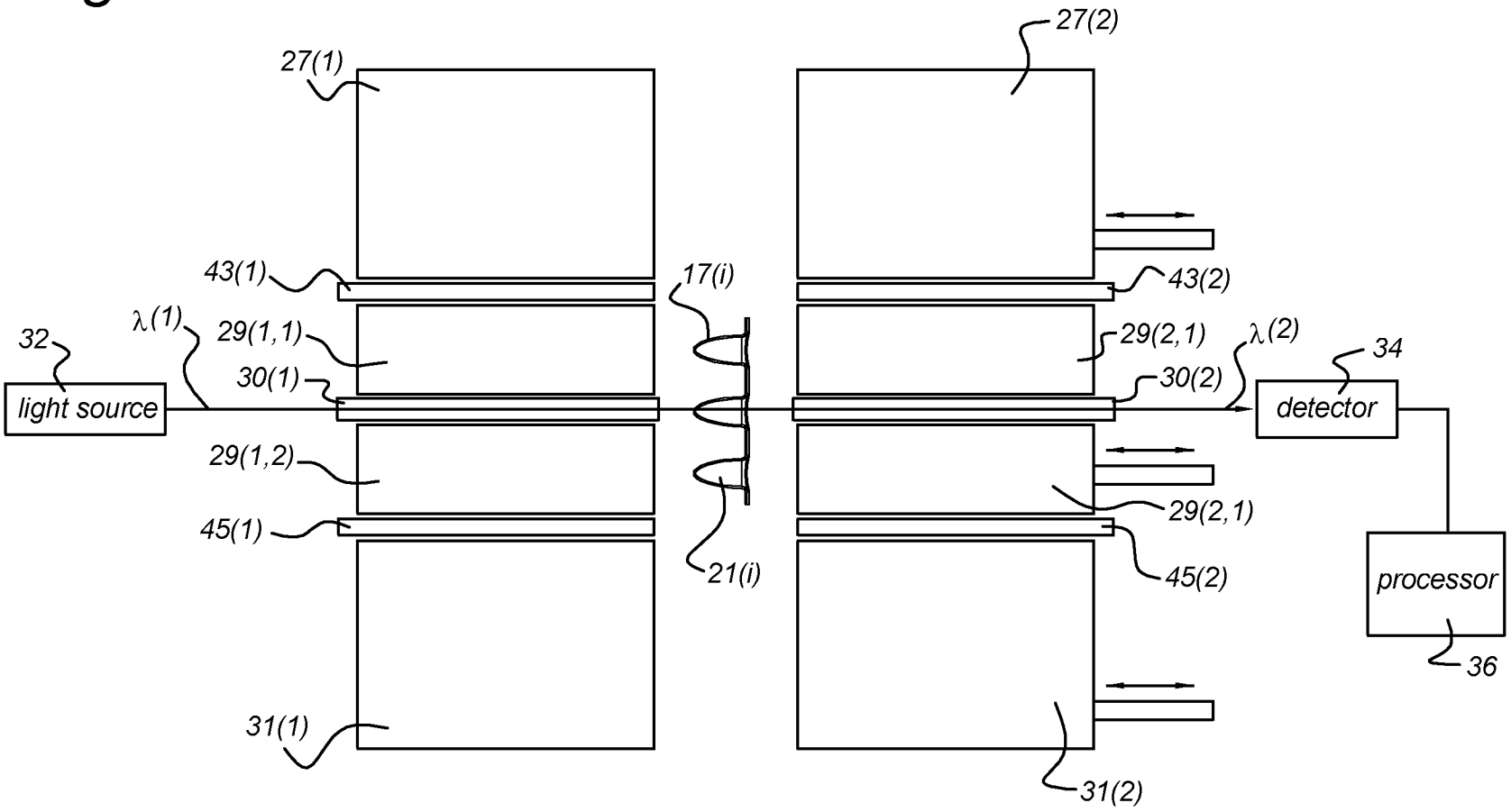

Alternatively the scanner can be constructed to fit inside the construction of blocks, employed for thermal cycling, as described above. This is shown in FIG. 2B. In order to do so, the scanner is integrated in the second set of heating blocks 29(1)/29(2). To that end each one of the second set of heating blocks 29(1)/29(2) is split into two heating subblocks 29(1,1)/29(1,2) and 29(2,1)/29(2,2). The heating subblocks 29(1,1)/29(1,2) are separated by a first layer 30(1) of a material that can be used as a lens. The heating subblocks 29(2,1)/29(2,2) are separated by a second layer 30(2) of a material that can be used as at least one of a lens and a filter. Both the first layer 30(1) and second layer 30(2) may be made as a sheet of glass or suitable polymer. A light source 32 is arranged to provide light of a predetermined wavelength λ1 to the bag 17(*i*) holding the reaction mix such that the label within the reaction mix is excited and emits light with a wavelength of λ2 caused by the excitation. A detector 34 such as a CCD-chip is arranged to receive the light with wavelength λ2. The detection unit 34 is connected to a suitable processor 36 arranged to receive an output signal from the detector 34, analyse it and to provide data as to the content of the mix in bag 17(*i*) based on the output signal.

The third set of heating blocks (31(1)/31(2) can be split in the same way such as to provide a similar scanner measuring in the third temperature zone 31(3).

The first and second layers 30(1), 30(2) are arranged such that they can be moved to one another by motor 39 in the same way as the heating blocks of the sets of heating blocks. In this way, during scanning with light with wavelength λ1 bags 17(*i*) are pressed together such as have two opposing, substantially flat sides at a predetermined distance as defined by the distance between the heating blocks of the second set of heating blocks 29(1), 29(2). Thus, the amount of DNA within each bag 17(*i*) is always measured in the same way, resulting in more reliable measurement data. Note that the bags 17(*i*) can be made of a very thin transparent material absorbing substantial no or only a very small amount of incoming and outgoing light.

Instead of using the construction as shown in FIG. 2*b*, light with wavelength λ1 can, alternatively, be transmitted into the space between the heating blocks from a direction perpendicular to the drawing surface. However, then, if there are several bags 17(*i*) adjacent to one another in the same direction, every bag 17(*i*) will receive an other amount of light. One should then compensate for this effect.

In a special version the heating block 31(2) for heating the mix within bag 17(*i*) to the extension temperature may be replaced by a lens at the same temperature.

It is to be understood that the invention is limited by the annexed claims and its technical equivalents only. In this document and in its claims, the verb "to comprise" and its conjugations are used in their non-limiting sense to mean that items following the word are included, without excluding items not specifically mentioned. In addition, reference to an element by the indefinite article "a" or "an" does not exclude the possibility that more than one of the element is present, unless the context clearly requires that there be one and only one of the elements. The indefinite article "a" or "an" thus usually means "at least one".

For instance, in this document, the term "set of heating blocks" is used to define heating blocks used to define a space to receive a substance and to heat the substance to a predetermined temperature, i.e. the temperature of the heating blocks. The drawings shows such sets to have two heating blocks. However, it should be understood that such sets may comprise three or more heating blocks.

The invention claimed is:

1. A system comprising:

a reaction mix unit comprising a first plastic foil having a plurality of bags extending from a surface and having first foil portions at surface locations located in the surface and surrounding the bags, each bag containing a reaction mix comprising Polymerase Chain Reaction (PCR) reaction mixes, and a second plastic foil distinct from the first plastic foil, located on top of the first plastic foil, and sealed to the first plastic foil at the first foil portions to cover the bags, the bags having a volume of between 5-100 μl, the bags being configured such that contents of the bags takes a new shape when a force in a range of 1-10N is applied to the bags, without the bags being destroyed by the force, the new shape being different in relation to a previous shape of the content of the bags prior to the force being applied;

a temperature control device configured to control a temperature of the reaction mix to obtain a first temperature and to change to a second temperature;

at least a first heating block and a second heating block; and a heating device configured to heat said first heating block to said first temperature and to heat said second heating block to said second temperature, wherein the temperature control device includes a first object comprising one of an additional first heating block and a first isolator disposed opposite to the first heating block to define a first space between the first object and the first heating block to receive said reaction mix unit and define a first temperature zone having the first temperature, and a second object comprising one of an additional second heating block and a second isolator disposed opposite to the second heating block to define a second space between the second object and the second heating block to receive the reaction mix unit and defining a second temperature zone having the second temperature, the first and second spaces being disposed such that the reaction mix unit is able to be moved from the first temperature zone to the second temperature zone.

2. The system according to claim 1, wherein the system comprises at least a first set of heating blocks and a second set of heating blocks, the heating device being configured to heat said first set of heating blocks to said first temperature and to heat said second set of heating blocks to said second temperature, the first set of heating blocks being separated from the second set of heating blocks by a temperature isolating material.

3. The system according to claim 2, wherein the temperature isolating material is made of polyoxymethylene.

4. The system according to claim 1, wherein the heating blocks are made of one of a metal, a bag filled with a liquid, and a bag filled with gas.

5. The system according to claim 2, wherein the temperature control device comprises a driving device configured to move said first heating block and said first object relative to one another, and to move said second heating block and said second object relative to one another to press against the reaction mix unit and mix the reaction mix, causing faster heat transmission to the reaction mix.

6. The system according to claim 5, wherein the driving device is configured to press against the reaction mix unit with a force in a range between 1-10 N.

7. The system according to claim 1, further comprising a scanner including a light source configured to produce light with a first wavelength, a first lens configured to direct said light to the reaction mix unit, a detector configured to receive light emitted from the reaction mix unit at a second wavelength, and a processor connected to said detector to receive an output signal from said detector and to analyze reaction mixes within the bags based on said received output signal.

8. The system according to claim 1, further comprising:

a first set of heating blocks and a second set of heating blocks, the heating device being configured to heat the first set of heating blocks to the first temperature and to heat the second set of heating blocks to the second temperature, the first set of heating blocks being separated from the second set of heating blocks by a temperature isolating material; and a scanner including a light source configured to produce light with a first wavelength, a first lens configured to direct the light to the reaction mix unit, a detector configured to receive light emitted from the at least one bag at a second wavelength, and a processor connected to said detector to receive an output signal from said detector and to analyze reaction mixes within the bags based on the received output signal, a first one of said second set of heating blocks comprising a first subset of heating blocks, said first lens being disposed between individual ones of at least one of said first subset of heating blocks.

9. The system according to claim 8, wherein the second additional heating block comprises two other additional separate heating blocks, and the scanner further includes a second lens disposed between the two other additional separate heating blocks in order to receive said light emitted from the reaction mix unit at said second wavelength and transmit the light to said detector.

10. The system according to claim 1, wherein at least the first heating block comprises slots in surfaces opposing one another.

11. The system according to claim 1, further comprising at least a first set of heating blocks and a second set of heating blocks, the heating device being configured to heat the first set of heating blocks to the first temperature and to heat the second set of heating blocks to the second temperature, the first set of heating blocks being separated from the second set of heating blocks by a temperature isolating material, the first and second sets of heating blocks being disposed on a circle such that all said temperature zones are located on said circle.

12. The system according to claim 1, wherein the first heating block and the second heating block are integral parts of a third heating block having first and second end portions, the first heating block being formed by the first end portion and the second heating block being formed by a portion between the first and second end portions.

13. The system according to claim 1, wherein said heating device is configured to control said first heating block to be on said first temperature and said second heating block to be on said second temperature to allow a PCR process to be performed within said bag.

14. The system according to claim 13, wherein the temperature control device comprises at least a first set of heating blocks, a second set of heating blocks, and a third set of heating blocks, the heating device being configured to heat the first set of heating blocks to the first temperature, to heat the second set of heating blocks to the second temperature, and to heat said third set of heating blocks to a third temperature, said first temperature being in a range of 367-369 K, the second temperature being in a range of 321-343 K, and the third temperature being in a range of 345-347 K.

15. The system according to claim 1, wherein the bag is made of one of polypropylene, polyethylene, polyethene, PMMA, polycarbonate and other transparent materials.

16. The system according to claim 1, wherein each individual one of the heating blocks has a heat capacity between 80 and 1000 J/K.

17. The system according to claim 1, wherein said bags have a volume in a range of 10 to 50 μl.

18. The system according to claim 1, wherein said bags are disposed in a matrix arrangement of a plurality of rows and a plurality of columns.

19. The system according to claim 1, wherein the heating blocks have a heat capacity which is at least 10 times higher than a heat capacity of the reaction mix unit.

* * * * *